United States Patent [19]

Murakami et al.

[11] 4,074,333

[45] Feb. 14, 1978

[54] A.C. RELAY SYSTEM

[75] Inventors: Kanemichi Murakami; Yoshihiro Ishida; Kazuo Okubo, all of Ise, Japan

[73] Assignee: Shinko Electric Company, Ltd., Tokyo, Japan

[21] Appl. No.: 705,708

[22] Filed: July 15, 1976

[51] Int. Cl.[2] ..... H01H 33/59

[52] U.S. Cl. ..... 361/13

[58] Field of Search ..... 361/13, 3

[56] References Cited

U.S. PATENT DOCUMENTS

| | | | |
|---|---|---|---|
| 3,321,668 | 5/1967 | Baker | 361/13 X |
| 3,558,910 | 1/1971 | Dale et al. | 361/13 X |
| 3,639,808 | 2/1972 | Ritzow | 361/13 |

*Primary Examiner*—Harry E. Moose, Jr.
*Attorney, Agent, or Firm*—Lane, Aitken, Dunner & Ziems

[57] ABSTRACT

An A.C. relay system for making and breaking an A.C. power line utilizing an electromagnetic relay having a coil for opening and closing the mechanical switching contacts, a bilateral gated semiconductor such as a triac connected across the contacts, and a control circuit for switching the relay and triac in proper sequence is disclosed. The control circuit comprises a sequence control unit, a phase detector, a triac firing unit and a relay energizing unit. Upon actuation of the sequence control unit, the triac firing unit first fires the triac and then the relay energizing unit energizes the coil to close the mechanical contacts. To break the A.C. power line, the sequence control unit first de-energizes the relay energizing unit and then after a suitable time interval de-energizes the triac firing unit to cut off the gate signal, the triac being turned off when the load current on the power line is below a triac holding current.

2 Claims, 2 Drawing Figures

A.C. RELAY SYSTEM

BACKGROUND OF THE INVENTION

The present invention relates generally to an electric relay system and more particularly, to a relay system for switching an A.C. power line utilizing a combination of an electromagnetic type relay having mechanical contacts, a bilateral gated semiconductor switch such as a triac having no mechanical contacts, and a control circuit for coordinating the switching actions of the relay and the triac.

Among presently available switching devices for making or breaking alternating current circuits are electromagnetic type relays having mechanical switching contracts which can be opened and closed under electromagnetic force, and semiconductor devices such as bilateral gated semiconductors having no mechanical witching contacts. The mechanical switching contacts in electromagnetic type relays tend to produce electric arcs when the contacts are opened. Therefore, great care must by expended when such relays are used in locations such as factories and warehouses having environments in which explosive or ignitable gases, liquids, dusts, or similar substances may be present. When a mechanical type relay is used an aircraft or ship, provision must also be made for preventing the generation by induction of interfering radio waves due to switching of the relay. An additional problem with the mechanical type of relay switching is that the switching contacts gradually wear away and sometimes are fused together.

On the other hand, the bilateral gated semiconductor switching device is disadvantageous in that it has non-negligible internal resistance which results in heat generation when in a conducting condition and requires a cooling fin of large size to dissipate the heat and prevent thermal breakdown. Thus, a relay of this type frequently is larger in size and greater in weight than the electromagnetic type relay for a given rating. Furthermore, the voltage drop across the device when the semiconductor relay is conducting is typically from 1.0 to 1.5V which is much greater than for a mechanical relay.

SUMMARY OF THE INVENTION

One illustrative embodiment of the present invention comprises an A.C. relay system for making and breaking an A.C. power line, comprising in combination:

an electromagnetic relay having contacts for making and breaking the power line and a coil for opening and closing the contact;

a bilateral gated semiconductor connected across the contacts; and a control circuit for controlling the relay and semiconductor, the circuit comprising: a sequence control unit receptive of an energizing signal from an external source, a phase detector having inputs connected to the sequence control unit and to one of the terminals of the semiconductor, a relay firing unit having an input connected to the phase detector and outputs connected to the gate of the semiconductor and to the sequence control unit, and a relay energizing unit having an input connected to the sequence control unit and an output connected to the coil of the relay.

It is, accordingly, a principle object of the present invention to provide an A.C. relay system having combined an electromagnetic relay and a bilateral semiconductor switching device which are arranged to obviate the drawbacks inherent in such a relay or switching device operating by itself.

Another object of the present invention is to provide a non-arcing A.C. relay system which further provides a relatively small voltage drop when the relay system is rendered conductive.

A still further object of the invention is the provision of an A.C. relay system which is reduced in size and weight.

These and other objects and advantages of the present invention will be evident from the following description and the accompanying drawings.

BRIEF DESCRIPTION OF THE DRAWINGS

Reference will now be made to the accompanying drawings in which.

DESCRIPTION OF THE PREFERRED EMBODIMENT

Figure 1:
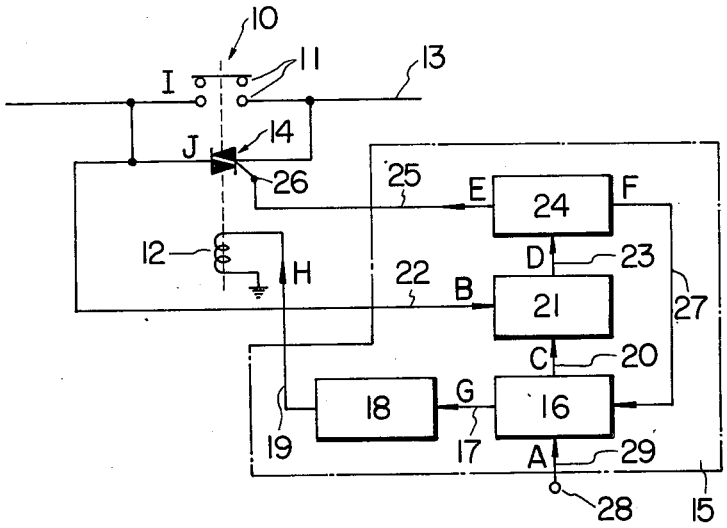
FIG. 1 is a functional block diagram, partially in circuit form, of a preferred embodiment of an A.C. relay system of the present invention.

In FIG. 1, an electromagnetic relay 10 has contacts 11 and a coil 12 for opening and closing the contacts 11, the contacts being arranged to connect and disconnect a power line 13 coupled to a power supply and a load, both not shown. A bilateral gated semiconductor 14 such as a triac is conencted across the relay 10. Indicated generally at 15 as enclosed by a dot-dash line is a circuit for controlling the switching operations of the relay 10 and the triac 14. The control circuit 15 comprises a sequence control unit 16 for giving an operating sequence for the relay 10 and the triac 14, an output of the unit 16 being connected over a line 17 to the input of a relay energizing unit 18 having the output connected over a line 19 to the coil 12 of the relay 10. Another output of the control unit 16 is connected over a line 20 to an input of a phase detector 21 which has another input connected over a line 22 to one of the terminals of the triac 14. The phase detector 21 detects the phase angle of a voltage of the power supply and when the phase angle is zero, generates a signal. The output of the phase detector 21 is connected over a line 22 to a triac firing unit 24 having an output coupled over a line 25 to a gate 26 of the triac 14. The unit 24 has another output connected over a line 27 to an input of the sequence control unit 16. An external source 28 can produce a energizing signal on a input line 29 to an input of the sequence control unit 16 for actuating the control circuit 15.

Figure 2:
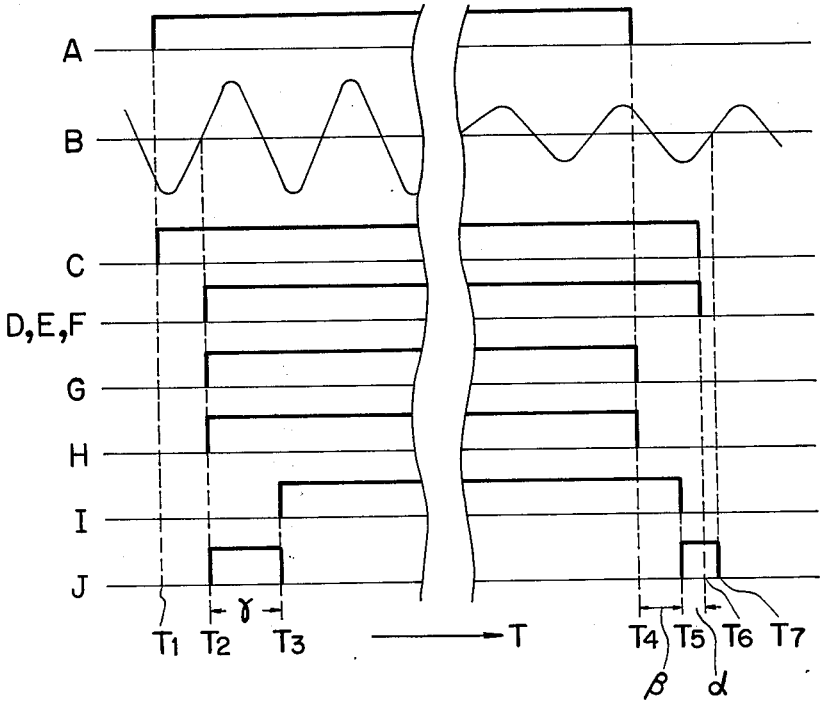
FIG. 2 is a series of time-related electrical waveforms that are present at various points in the system.

FIG. 2 shows time-related waveforms of signals produced as various points in FIG. 1, the waveforms being indicated by same charactor.

In operation, the energizing signal A from the external source at time T1 is applied to the input of the sequence control unit 16, whereupon a signal C is produced over the line 20 to the phase detector 21. A waveform B of the power supply voltage is applied over the line 22 to the input of the phase detector 21 which, when the phase angle of the waveform B becomes zero at a time T2, produces a signal D on the line 23, the signal D energizes the unit 24 which then applies a firing signal E over line 25 to the gate 26, thereby firing the triac 14. At the same time, the triac firing unit 24 generates a feedback signal F on the line 27, which is applied to the input of the control unit 16 which is then operated to provide a signal G over the line 17 to the unit 18. The unit 18 generates a signal H on line 19 to the coil 12 of the relay 10, thereby actuating relay 10 to close the contacts 11 at the time T3 after a time interval Γ. After contacts 11 close, the current flowing on power line 13 passes principally through the contacts 11, contacts 11 having a substantially lower resistance than triac 14 in the conducting state. Triac 14 then switches to the non-conducting state when the portion of the current on power line 13 passing through it drops below the holding current for triac 14. At the instant before contacts 11 close, the potential difference across contacts 11 is very low, being limited to the voltage drop across the triac in the conducting state, so that an electric arc can be prevented from being generated when the relay 14 is energized. Signals I and J in FIG. 2 illustrate the time intervals during which the relay 10 and the triac 14 are actuated, respectively.

In order to disconnect the power line at time T4, the energizing signal A is cut off, causing the sequence control unit 16 to interrupt the signal G, whereupon the relay energizing unit 18 is turned off to discontinue the signal H thereby de-energizing the coil 12. The contacts 11 of the relay 10 then open at time T5 upon lapse of a time interval $\beta$. At the instant contacts 11 open, the current flow on power line 13 is diverted to pass through the triac 14 which is permitted to switch to the conducting state by the signal E on gate 26. Therefore, no electric arc is produced between the contacts 11 as they open. The sequence control unit 16 is set so as to interrupt the output signal C at time T6 upon lapse of a time interval $\alpha$, the gate signal E from the triac firing unit 24 becoming zero accordingly. The triac 14 is maintained in a conducting condition until the load current on the power line 13 drops below the holding current for triac 14; in other words, when the phase angle of the load current becomes substantially zero at time T7, the triac 14 automatically switches to the non-conducting state. Accordingly, the system of the invention breaks the power line when the load current is zero, so that no electric arcs and hence no inductive interference radio waves the words are generated.

It will be appreciated that various additions and modifications may be made in the system described herein without departing from the essential features of novelty thereof, which are intended to be defined and secured by the appended claim.

What is claimed is:

1. An A.C. relay system for making and breaking an A.C. power line, comprising in combination:

an electromagnetic relay having contacts for making and breaking the power line and a coil for opening and closing said contacts;

a bilateral gated semiconductor connected across said contacts; and a control circuit for controlling said relay and semiconductor, said circuit comprising; a sequence control unit receptive of an energizing signal from an external source, a phase detector having inputs connected to said sequence control unit and to one of the terminals of said semiconductor, a semiconductor firing unit having an input connected to said phase detector and outputs connected to the gate of said semiconductor and to said sequence control unit, and a relay energizing unit having an input connected to said sequence control unit and an output connected to said coil of the relay, said sequence control unit being adapted to be actuated by said energizing signal to energize said phase detector, said phase detector energizing said semiconductor firing unit so as to fire said semiconductor when the phase angle of a voltage on the power line is zero, said semiconductor firing unit simultaneously producing a signal to said sequence control unit for actuating said relay energizing unit thereby actuating said relay and turning off said semiconductor, and upon cessation of said energizing signal said sequence control unit deenergizing said relay energizing unit to open said contacts so that a load current of the power line is directed to pass through said semiconductor, said sequence control unit upon lapse of a suitable time interval de-energizing said semiconductor firing unit to interrupt the gate signal, and said semiconductor becoming turned off when the load current drops below a holding current for said semiconductor.

2. An A.C. relay system for making and breaking an A.C. power line, comprising in combination:

an electromagnetic relay having contacts for making and breaking the power line;

a triac device connected across the contacts on the relay, and control circuit means for controlling the switching action of the relay and the triac device comprising sequence control means for sequencing the switching action of the relay and the triac device in response to a signal from an external source, said sequence control means firing said triac immediately when the voltage on said power line first crosses zero voltage after receiving said signal and energizing said relay in response to firing said triac.

* * * * *